US007752787B2

(12) United States Patent
Duffy

(10) Patent No.: US 7,752,787 B2
(45) Date of Patent: Jul. 13, 2010

(54) ELECTRICAL CABLE IDENTIFICATION SYSTEM

(76) Inventor: Gene P. Duffy, P.O. Box 1866, Klamath Falls, OR (US) 97601

( * ) Notice: Subject to any disclaimer, the term of this patent is extended or adjusted under 35 U.S.C. 154(b) by 0 days.

(21) Appl. No.: 12/060,575

(22) Filed: Apr. 1, 2008

(65) Prior Publication Data

US 2009/0241384 A1 Oct. 1, 2009

(51) Int. Cl.
*G09F 3/00* (2006.01)

(52) U.S. Cl. ..... 40/316; 40/673; 439/491; 174/112

(58) Field of Classification Search ..... 40/316; 174/112

See application file for complete search history.

(56) References Cited

U.S. PATENT DOCUMENTS 885,695 A * 4/1908 Jewett ..... 40/316
1,442,224 A * 1/1923 Knott et al. ..... 40/673
1,584,238 A 5/1926 Menger
2,567,181 A 9/1951 Bye
4,139,956 A * 2/1979 Sharrow ..... 40/316
4,250,608 A 2/1981 Mulkey
5,111,605 A * 5/1992 Bossi ..... 40/316
5,157,853 A * 10/1992 Piana et al. ..... 40/316
5,343,647 A * 9/1994 Bulka ..... 40/630
5,862,774 A 1/1999 Moss
5,887,368 A 3/1999 Rupp
5,896,826 A 4/1999 Winer
6,651,362 B2 11/2003 Caveney
6,962,014 B2 11/2005 McCabe et al.
2004/0194360 A1 * 10/2004 McCabe et al. ..... 40/316

* cited by examiner

*Primary Examiner*—Cassandra Davis
(74) *Attorney, Agent, or Firm*—Gerald D Haynes

(57) ABSTRACT

An electrical cable identification system for efficiently identifying electrical cables during and after circuit breaker installation. The electrical cable identification system generally includes an identification tab including a first end and a second end, a connecting portion integral with the first end and an identifier portion integral with the second end. The connecting portion is comprised of a thin configuration to slide between an outer sheath of an electrical cable and at least one inner wire encompassed by the outer sheath and a marking is located upon the identifier portion to identify the electrical cable.

10 Claims, 8 Drawing Sheets

ELECTRICAL CABLE IDENTIFICATION SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to electrical cable identifiers and more specifically it relates to an electrical cable identification system for efficiently identifying electrical wires during and after circuit breaker installation.

2. Description of the Related Art

Any discussion of the related art throughout the specification should in no way be considered as an admission that such related art is widely known or forms part of common general knowledge in the field.

Electrical cable identifiers have been in use for years and are utilized during various applications requiring the identification of electrical cables or wires. One such application is during the installation of multiple circuit breakers. When installing an electrical panel including multiple circuit breakers, the multiple electrical cables and wires are first inserted within the electrical panel. After inserting a majority or all of the electrical cables and wires within the electrical panel, the electrical wires must be electrically connected to a desired circuit breaker.

It is often necessary between the steps of inserting the wires within the electrical panel and connecting the wires to the circuit breaker to label each wire with what the particular wire is connected to (e.g. bathroom lights, refrigerator, pump, etc.) so that the respective circuit breaker may be properly labeled. In the past, the electrical wires have been labeled in various ways, such as by writing upon the cable or sticking a piece of tape to the cable and writing upon the tape. This is generally very cumbersome, in that it may be difficult to write upon the electrical cables, because of their small size and handling tape, a writing tool and the cables all simultaneously may be difficult.

These prior methods are also not generally efficient in that the tape or markings may wear away over time, thus making it difficult to distinguish between electrical wires during later maintenance of the electrical panel. Because of the inherent problems with the related art, there is a need for a new and improved electrical cable identification system for efficiently identifying electrical cables during and after circuit breaker installation.

BRIEF SUMMARY OF THE INVENTION

The general purpose of the present invention is to provide an electrical cable identification system that has many of the advantages of the electrical cable identifiers mentioned heretofore. The invention generally relates to an electrical cable identifier which includes an identification tab including a first end and a second end, a connecting portion integral with the first end and an identifier portion integral with the second end. The connecting portion is comprised of a thin configuration to slide between an outer sheath of an electrical cable and at least one inner wire encompassed by the outer sheath and a marking is located upon the identifier portion to identify the electrical cable.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

An object is to provide an electrical cable identification system for efficiently identifying electrical cables during and after circuit breaker installation.

Another object is to provide an electrical cable identification system that may be attached on a variety of different sized electrical wires and cables (e.g. NM cables, MC cables, etc.).

An additional object is to provide an electrical cable identification system that provides for a permanent marking upon the electrical wire.

A further object is to provide an electrical cable identification system that allows for a smoother and more efficient process of installing electrical wires within an electrical panel.

Another object is to provide an electrical cable identification system that may be utilized to distinguish various other types of wires or cables rather than electrical wires.

Other objects and advantages of the present invention will become obvious to the reader and it is intended that these objects and advantages are within the scope of the present invention. To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
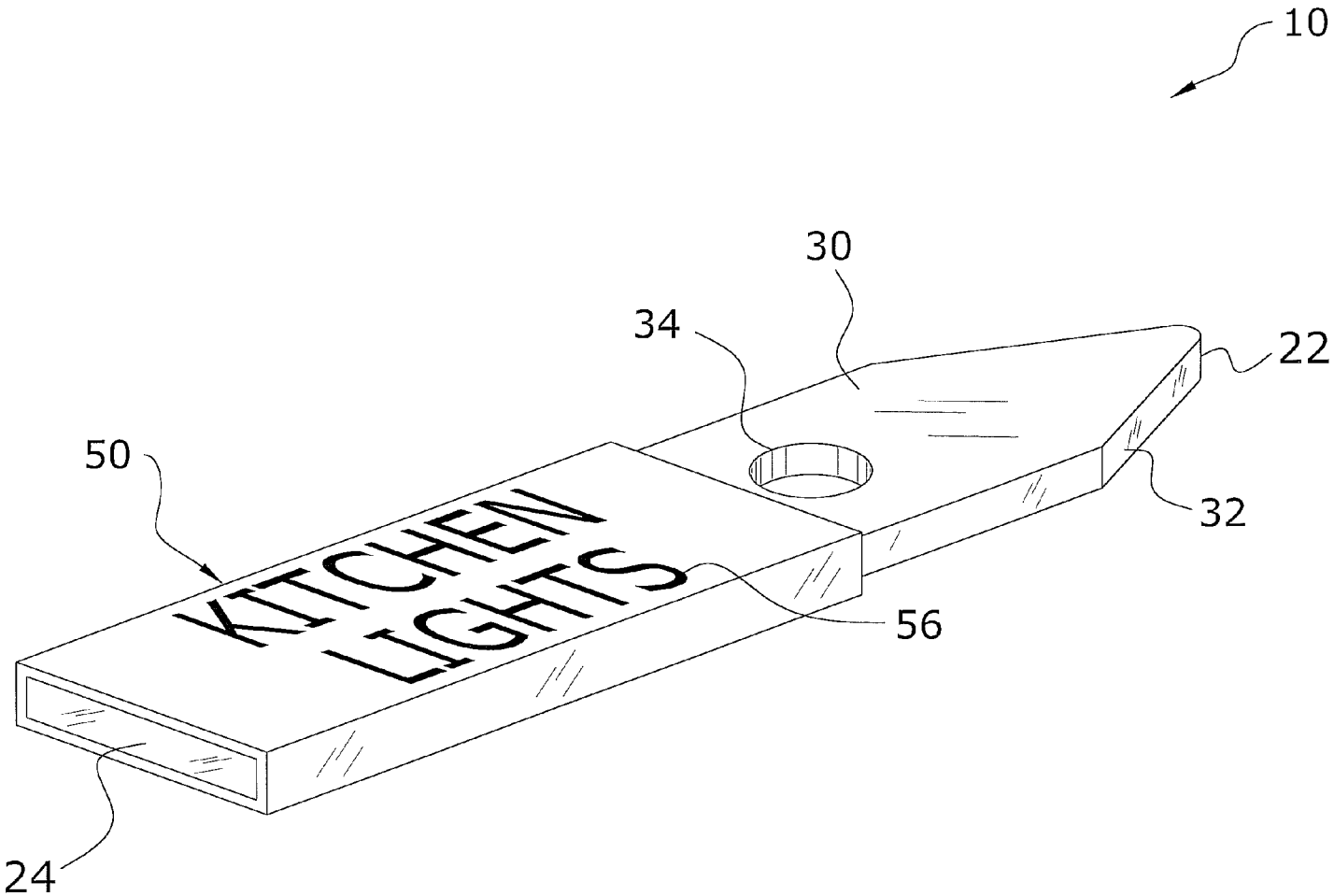
FIG. 1 is an upper perspective view of the present invention.
Figure 2:
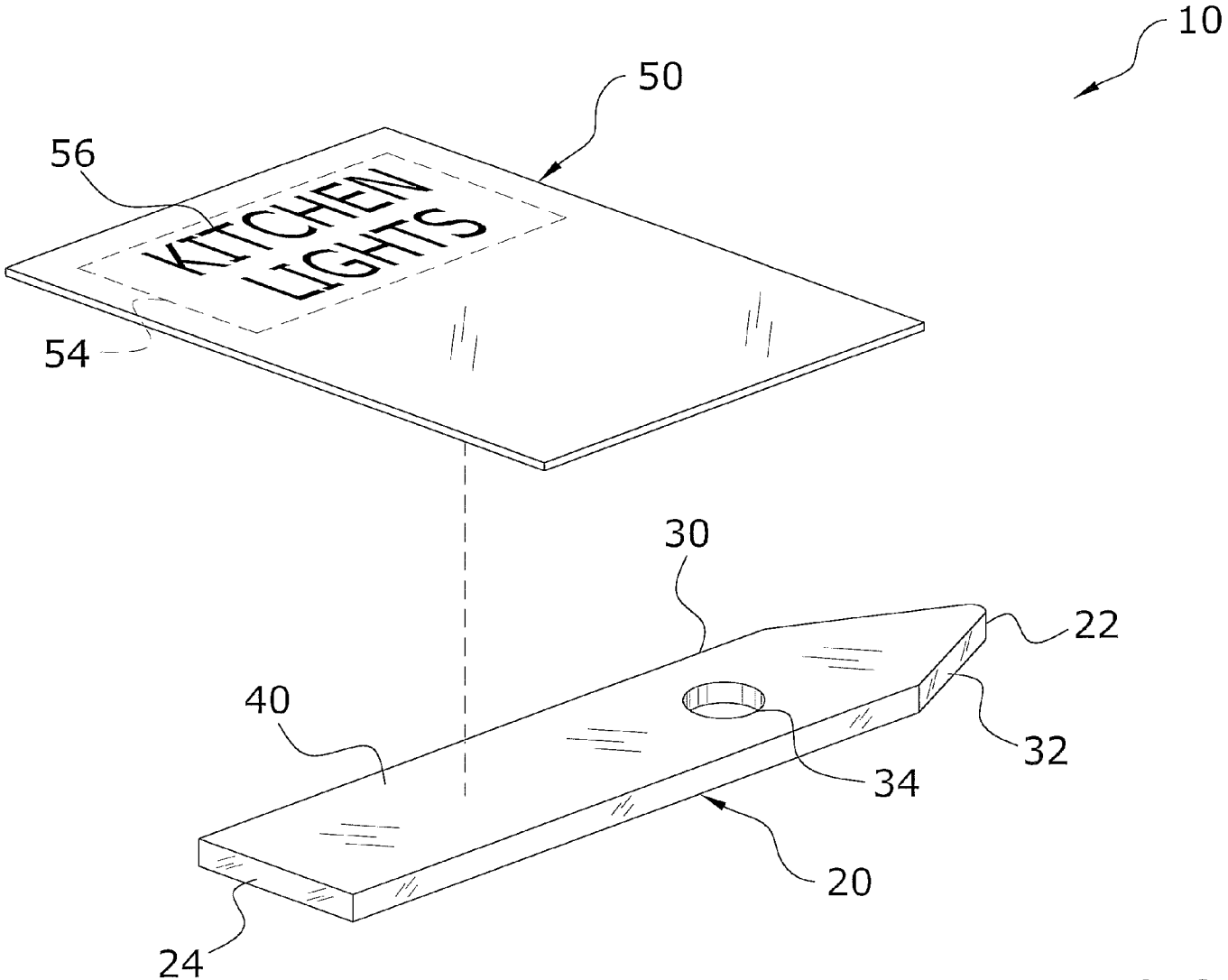
FIG. 2 is an upper perspective view of the present invention with the label exploded from the identification tab.
Figure 3:
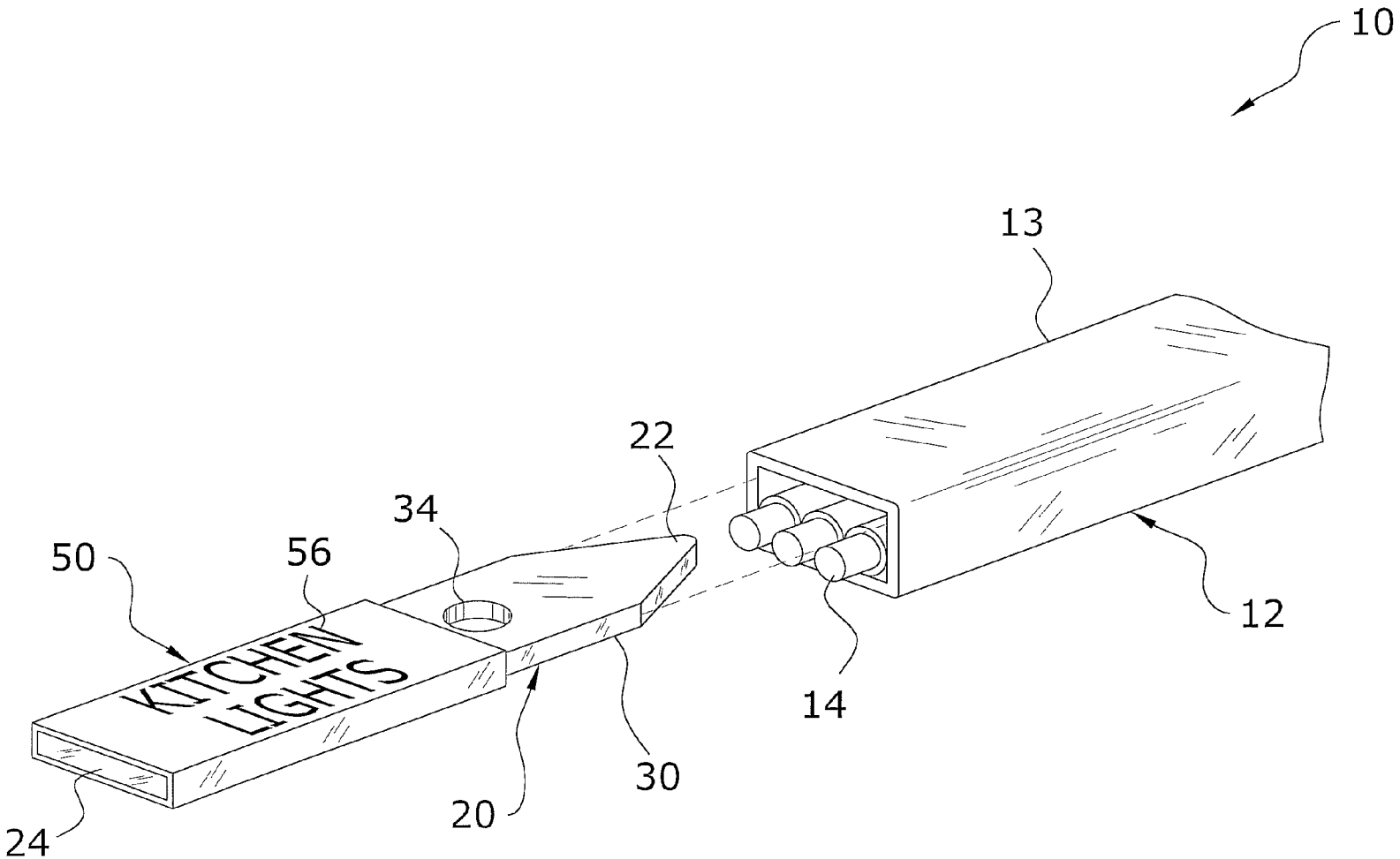
FIG. 3 is an upper perspective view of the present invention exploded from an electrical cable.
Figure 4:
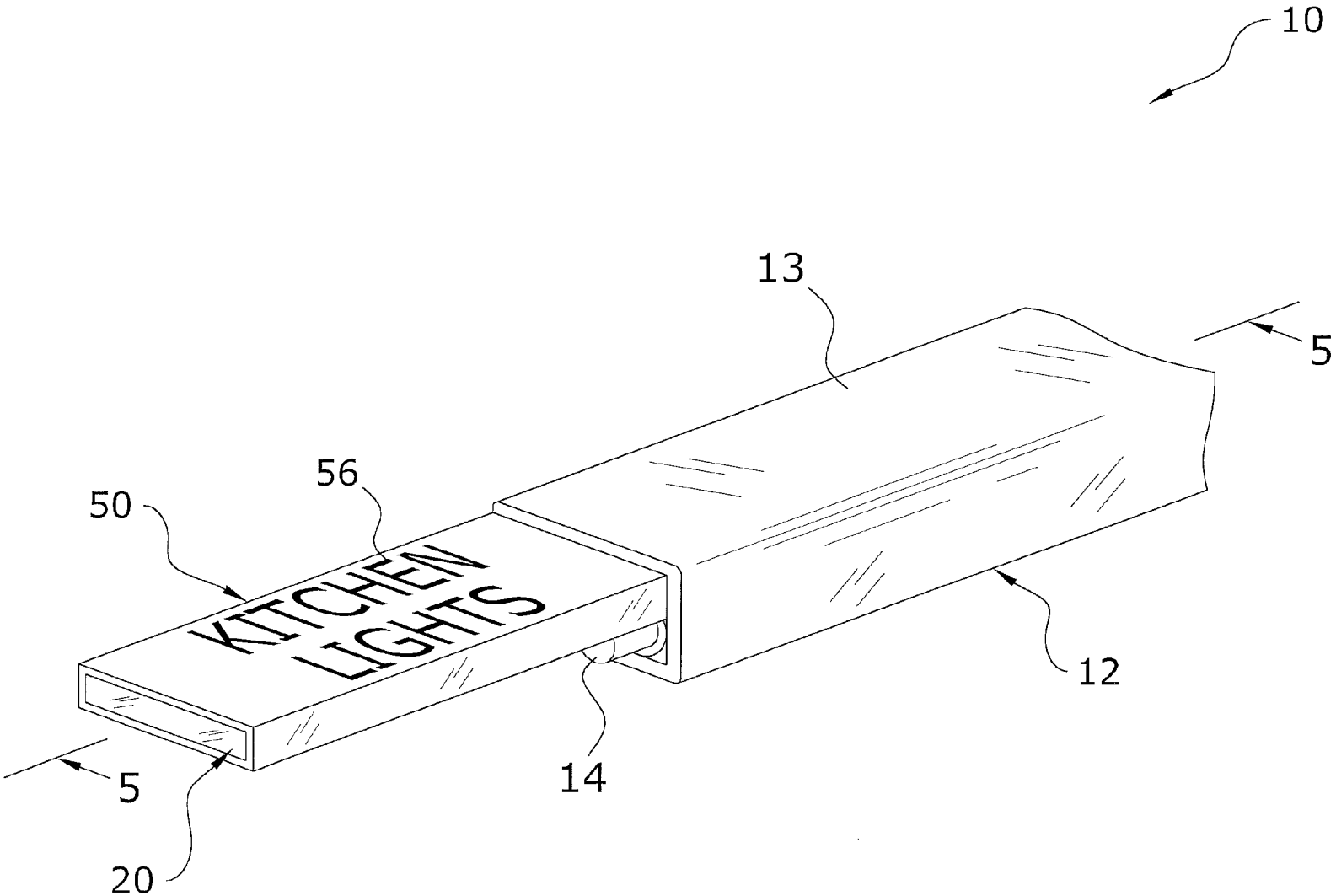
FIG. 4 is an upper perspective view of the present invention inserted within an inner space of an electrical cable.
Figure 5:
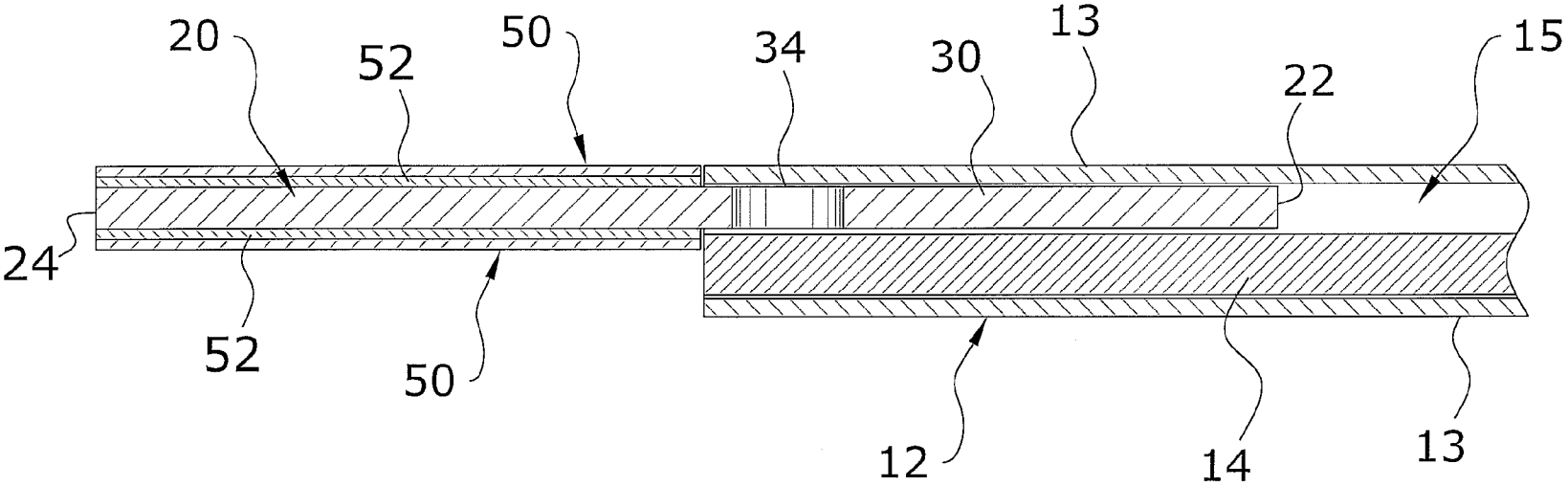
FIG. 5 is a sectional view taken along lines 5-5 of FIG. 4.
Figure 6:
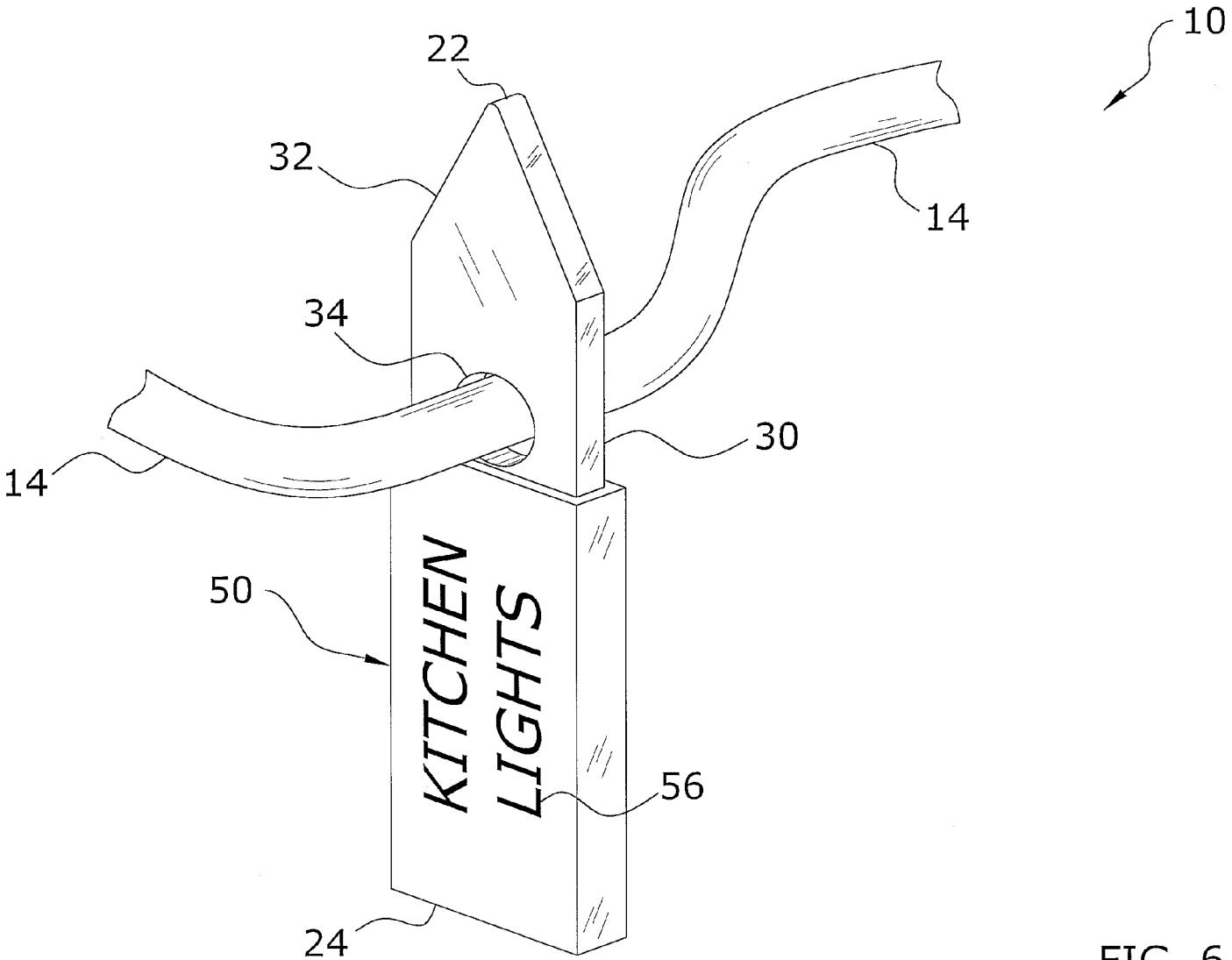
FIG. 6 is an upper perspective view of the present invention attached to a wire of an electrical cable.
Figure 7:
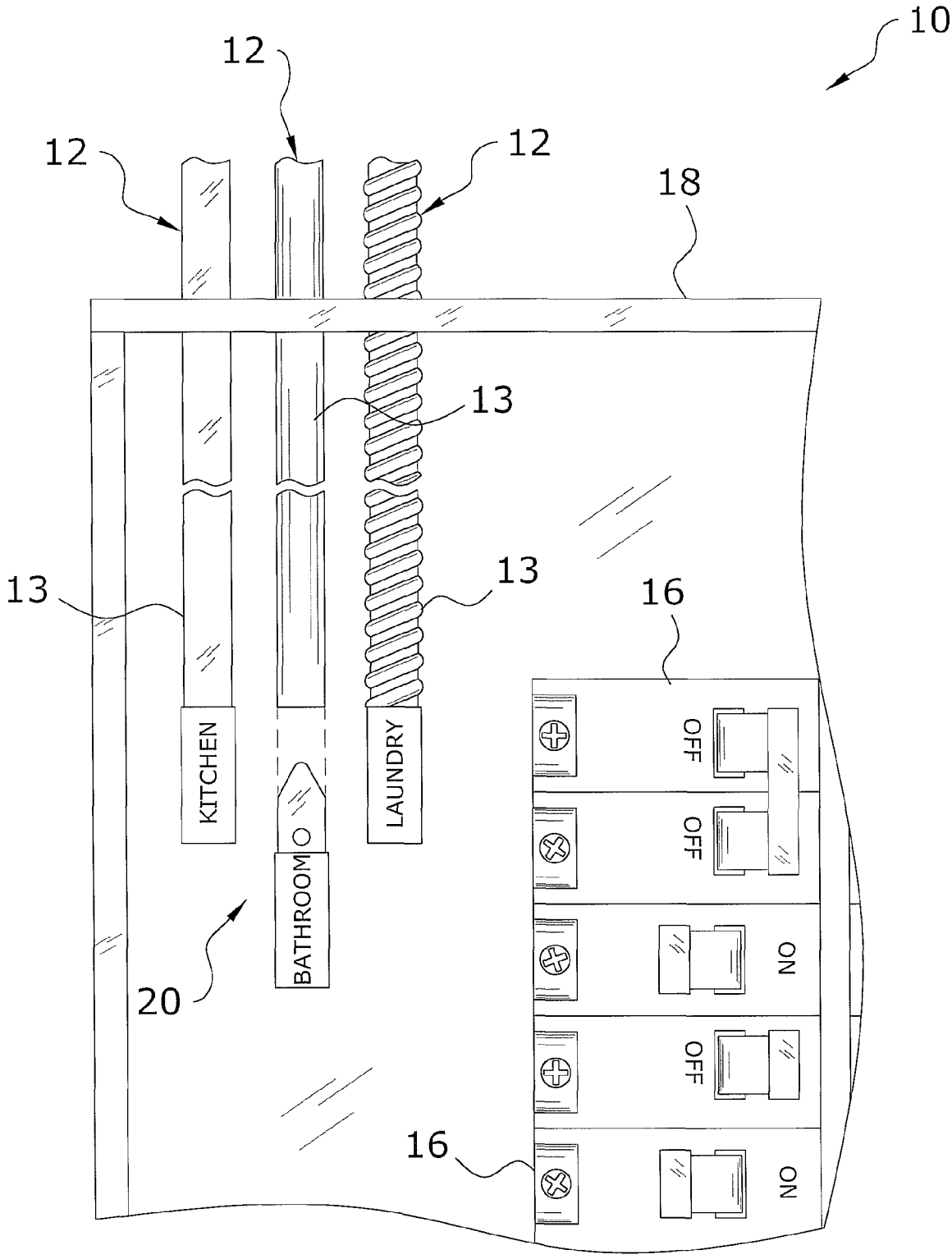
FIG. 7 is a front view of the present invention attached to the electrical cable utilizing a first method of attachment (i.e. inserting wedge portion within inner space of electrical cable), wherein the electrical cables are inserted within an electrical panel.
Figure 8:
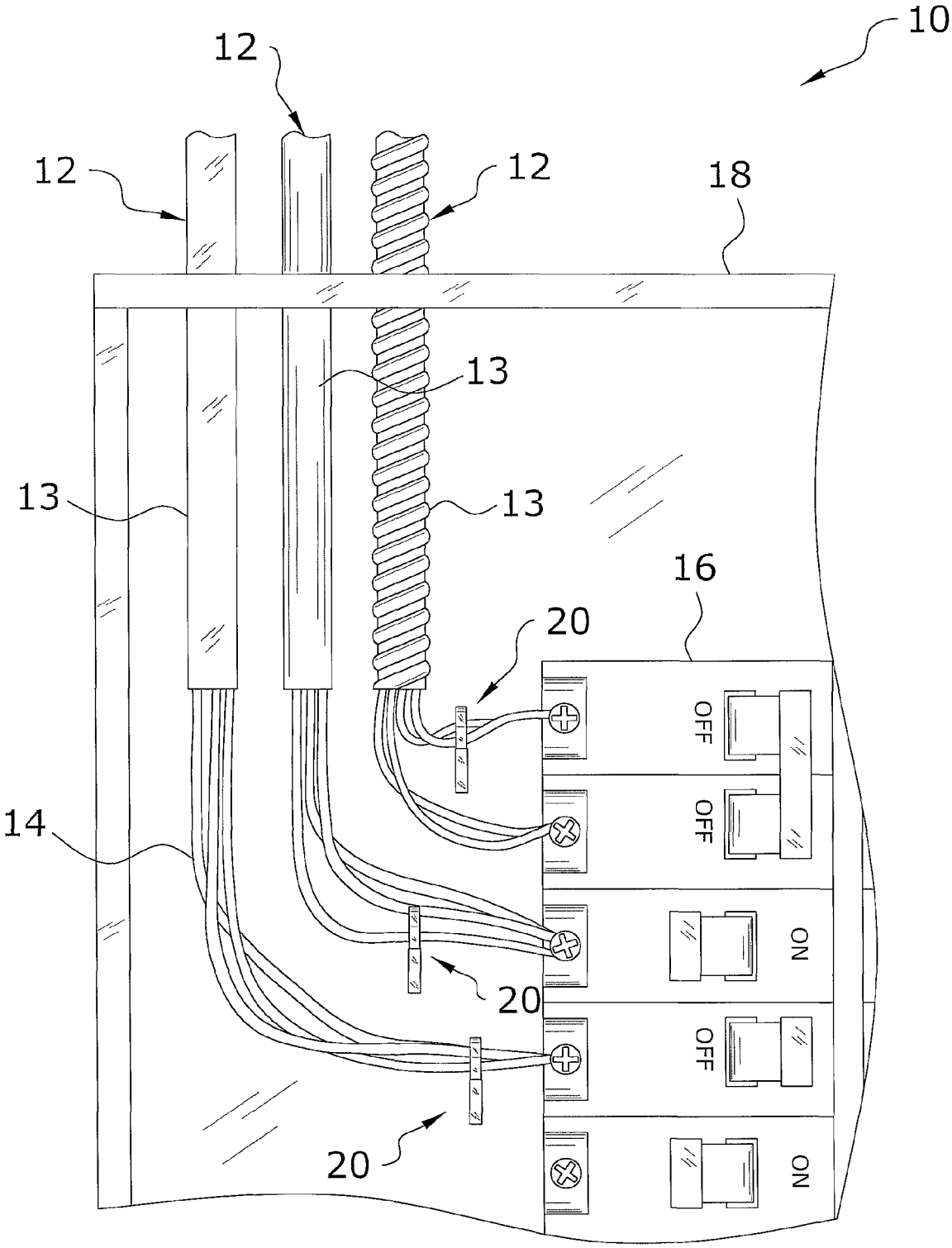
FIG. 8 is a front view of the present invention attached to the electrical cable utilizing a second method of attachment (i.e. extending wires through the opening of the connecting portion), wherein the electrical cables are electrically connected to the circuit breakers within the electrical panel.

Turning now descriptively to the drawings, in which similar reference characters denote similar elements throughout the several views, FIGS. 1 through 8 illustrate an electrical cable identification system 10, which comprises an identification tab 20 including a first end 22 and a second end 24, a connecting portion 30 integral with the first end 22 and an identifier portion 40 integral with the second end 24. The connecting portion 30 is comprised of a thin configuration to slide between an outer sheath 13 of an electrical cable 12 and at least one inner wire 14 encompassed by the outer sheath 13 and a marking 56 is located upon the identifier portion 40 to identify the electrical cable 12.

B. Identification Tab

The identification tab 20 is utilized to attach to an individual electrical cable 12 so that the electrical cable 12 may be identified within an electrical panel 18. The tab 20 may also be utilized to attach to various other electrical cables 12 not within electrical panels 18 or attached to circuit breakers 16. The tab 20 may further be utilized to attach to various other types of cables or wires 14 rather than electrical cables 12. The tabs 20 are further reusable if desired to be utilized upon other electrical cables 12 than being currently utilized.

The tab 20 is preferably comprised of a plastic material or another type of material that does not conduct electricity and will not become damaged or deformed when positioned next to or against a live wire 14. The tab 20 may also be color coated to more easily allow a user to identify a respective electrical cable 12 that the tab 20 is attached to. It is appreciated that the term electrical cable 12 throughout the description of the present invention is meant to include a cable, wires 14 or associated electrical transfer device for transferring electrical current from an appliance, lighting fixture, other electrical device to a circuit breaker 16 within an electrical panel 18.

The tab 20 is preferably comprised of an elongated configuration, wherein the first end 22 of the tab 20 is distally spaced from the second end 24 so as to be able to firmly grasp the tab 20 when attaching the tab 20 to the electrical cable 12. The tab 20 or at least a connecting portion 30 of the tab 20 is also preferably comprised of a substantially thin configuration so as to fit between the outer sheath 13 of an electrical cable 12 and the electrical wire 14 enclosed within. The tab 20 preferably includes the connecting portion 30 and an identifier portion 40 extending from the connecting portion 30. The connecting portion 30 and the identifier portion 40 are preferably comprised of an integral structure; however it is appreciated that the connecting portion 30 and the identifier portion 40 may be comprised of separate structures.

The connecting portion 30 is preferably comprised of a substantially triangular or trapezoidal shaped configuration; however it is appreciated that the connecting portion 30 may be comprised of various configurations rather than the preferred embodiment. The connecting portion 30 preferably serves to connect to the electrical cable 12. The connecting portion 30 includes a wedge portion 32 extending outwardly from the connecting portion 30 opposite the identifier portion 40.

The wedge portion 32 is preferably comprised of a triangular shaped configuration and is utilized by inserting the wedge portion 32 between the outer sheath 13 of the electrical cable 12 and the electrical wires 14 within. The wedge portion 32 is thus preferably comprised of a substantially stiff material so as not to bend or break when inserting the wedge portion 32 within the electrical cable 12.

The connecting portion 30 also preferably includes an opening 34 extending through the connecting portion 30. The opening 34 also preferably extends through a center (i.e. crosswise) of the identification tab 20. The opening 34 is preferably comprised of a circular shaped configuration and receives the electrical wires 14 from the electrical cable 12. The opening 34 serves as an alternate or additional method of attaching the tab 20 to the electrical cable 12. The opening 34 may be comprised of various sizes, all which comfortably receive various size electrical wires 14.

An identifier portion 40 extends from the connecting portion 30, wherein the identifier portion 40 provides a large enough surface area to label 50 the tab 20 and thus associated electrical cable 12. The identifier portion 40 is preferably comprised of a rectangular shaped configuration; however it is appreciated that the identifier portion 40 may be comprised of various configurations rather than the preferred embodiment.

The identifier portion 40 includes a space with a large enough surface area to properly identify (e.g. via labeling with a pen or marker, labeling with a sticker, etc.) the electrical cable 12 and have enough room to not crowd the marking 56 so that the marking 56 is easily readable. It is appreciated that the marking 56 may be located directly upon the identifier portion 40 of the tab 20 rather than utilizing the label 50. The surface area of the identifier portion 40 may also be larger than the surface area of the connecting portion 30, wherein adequate marking space is generally needed upon the identifier portion 40.

C. Label

The present invention may include a label 50 to attach to the identifier portion 40, wherein the label 50 may allow for a user to easily write a desired marking 56 upon the label 50 or the label 50 may be premarked. The label 50 is preferably comprised of a flexible configuration to wrap around at least partially the identifier portion 40 of the tab 20. The label 50 may also be comprised of various other configurations all which may be affixed to the tab 20 in some manner so as not to peel off or disconnect over time or easily during use.

In the preferred embodiment, the label 50 is comprised of a sticker configuration and adhesive 52*ly* attaches to the identifier portion 40 via an adhesive 52 portion of the label 50. The label 50 also includes an indicia portion 54 opposite the adhesive 52 portion, wherein the indicia portion 54 is where the marking 56 is positioned. In the majority of the illustrated Figures, the marking 56 is depicted as reading "Kitchen Lights"; however it is appreciated that the marking 56 may display various descriptions (e.g. water heater, kitchen appliances, furnace, etc.) according to what the particular electrical cable 12 is attached to.

D. Operation of Preferred Embodiment

In use, the present invention is first utilized when installing the electrical cables 12 within the electrical panel 18 and continued to be used after the electrical cables 12 are attached to the circuit breakers 16. An electrical cable 12 is first provided, wherein the electrical cable 12 includes an outer sheath 13 encompassing at least one wire 14, wherein the electrical cable 12 is electrically attached to at least one electrical device (e.g. kitchen lights, water heater, bedroom lights, etc.).

After the electrical cable 12 is inserted within the electrical panel 18 (e.g. through a conduit, etc.) and the end of the outer sheath 13 is at least partially stripped, the wedge portion 32 of the tab 20 is inserted within an inner space 15 between the outer sheath 13 and the wires 14 until the tab 20 is firmly secured to the electrical cable 12. The proper descriptive label 50 is preferably already attached to the tab 20 prior to attaching the tab 20 to the electrical cable 12. The user may continue to insert more electrical cables 12 within the electrical panel 18 and attaching a respective tab 20 to the electrical cable 12 with the proper label 50 describing the electrical cables 12 intended use (e.g. kitchen lights, water heater, bedroom lights, etc.).

When an electrical cable 12 is desired to be attached to the circuit breaker 16, the respective tab 20 is removed from the electrical cable 12 by pulling the tab 20 outwards away from the electrical cable 12 and thus removing the wedge from within the electrical cable 12. The electrical wire 14 of the electrical cable 12 is now inserted through the opening 34 of the tab 20 and the electrical wire 14 is subsequently electrically attached to the circuit breaker 16 thus securing the tab 20 upon the electrical cable 12 adjacent the circuit breaker 16.

This process is repeated for all the other electrical cables 12 within the electrical panel 18 that are desired to be electrically connected to a circuit breaker 16. After all the electrical cables 12 are attached to a respective circuit breaker 16 the installation of the electrical panel 18 may be continued in a normal manner.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

I claim:

1. An electrical cable identification system, comprising:

an electrical cable having at least one inner wire encompassed by an outer sheath;

an identification tab including a first end and a second end;

a connecting portion integral with said first end;

a label having an adhesive backing to attach to said tab;

wherein said connecting portion is comprised of a thin configuration;

wherein said connecting portion is removably positioned between said outer sheath of said electrical cable and said at least one inner wire encompassed by said outer sheath;

an identifier portion integral with said second end; and a marking located upon said identifier portion to identify said electrical cable.

2. The electrical cable identification system of claim 1, wherein said connection portion includes a wedge portion.

3. The electrical cable identification system of claim 2, wherein said wedge portion is comprised of a triangular shaped configuration.

4. The electrical cable identification system of claim 1, wherein said connection portion includes an opening extending through said connecting portion.

5. The electrical cable identification system of claim 4, wherein said opening is adjacent said first end.

6. The electrical cable identification system of claim 1, wherein said identifier portion is comprised of a rectangular shaped configuration.

7. The electrical cable identification system of claim 1, wherein a first surface area of said identifier portion is greater than a second surface area of said connecting portion.

8. The electrical cable identification system of claim 1, wherein said label is attached to said identifier portion of said tab.

9. The electrical cable identification system of claim 1, wherein said label includes an indicia portion to include said marking.

10. A method of marking an electrical cable while installing the electrical cable within an electrical panel, comprising:

providing an electrical cable including an outer sheath encompassing at least one wire, wherein said electrical cable is electrically attached to at least one electrical device;

inserting an electrical cable within an electrical panel;

stripping at least a portion of an outer sheath of said electrical cable away from said at least one wire near an end of said electrical cable;

providing an identification tab;

marking said identification tab to correspond with said at least one electrical device;

inserting said identification tab within an inner space between said outer sheath and said at least one wire at said stripped end;

repeating said previous steps for any other electrical cables;

aligning said electrical cable with a circuit breaker;

removing said identification tab from within said inner space;

extending said at least one wire through an opening within said identification tab;

connecting said at least one wire to said circuit breaker;

securing said identification tab to said electrical cable; and repeating said aligning through said securing steps for said other electrical cables.

* * * * *